United States Patent [19]

Wenger

[11] Patent Number: 4,760,938

[45] Date of Patent: Aug. 2, 1988

[54] DISPENSER BOX AND SNAP OPEN/SNAP SHUT CLOSURE THEREFOR

[76] Inventor: Harry Wenger, 24 Day St., Clifton, N.J. 07011

[21] Appl. No.: 864,603

[22] Filed: May 19, 1986

[51] Int. Cl.[4] ..... B65D 5/72

[52] U.S. Cl. ..... 222/498; 222/517; 222/528; 222/531; 222/541; 222/566; 229/102; 229/125.02; 229/125.04

[58] Field of Search ..... 229/125, 126, 128, 17 R, 229/7 R, 44 R, 44 M, 102, 124; 220/257, 265, 266, 268, 269, 359, 89 A; 206/608, 611, 612, 620, 807; 222/498, 517, 527, 528, 529, 531, 533, 536, 537, 544, 541, 556, 559, 560, 566, , 567, 545, 572, 573; 16/225-227, 277, DIG. 13

[56] References Cited

U.S. PATENT DOCUMENTS

| | | | |
|---|---|---|---|
| 2,353,521 | 7/1944 | Steffens | 222/541 X |
| 2,764,338 | 9/1956 | Wenger | 229/44 R |
| 2,960,264 | 11/1960 | Walter | 229/17 R X |
| 3,184,137 | 5/1965 | Mohler | 222/528 X |
| 3,206,100 | 9/1965 | Wenger | 229/44 R |
| 3,239,110 | 3/1966 | Buter | 222/541 X |
| 3,249,252 | 5/1966 | Smith | 220/265 |
| 3,250,436 | 5/1966 | Kurtz | 222/541 X |
| 3,344,972 | 10/1967 | Robinson et al. | 229/17 R |
| 3,883,034 | 5/1975 | Rausing | 222/541 X |
| 4,096,948 | 6/1978 | Kuckenbecker | 222/541 X |
| 4,141,485 | 2/1979 | Lambert | 222/529 X |
| 4,168,003 | 9/1979 | Wysocki | 229/17 R X |
| 4,194,677 | 3/1980 | Wysocki | 229/17 R |

*Primary Examiner*—H. Grant Skaggs
*Assistant Examiner*—David H. Bollinger
*Attorney, Agent, or Firm*—Kirschstein, Kirschstein, Ottinger & Israel

[57] ABSTRACT

An aperture formed through a spring member increases the size of the angle of inclination which the spring member assumes relative to a vertical side wall of a dispenser box. The spring member is utilized in a box closure for opening and closing the box.

9 Claims, 1 Drawing Sheet

FIG. 1
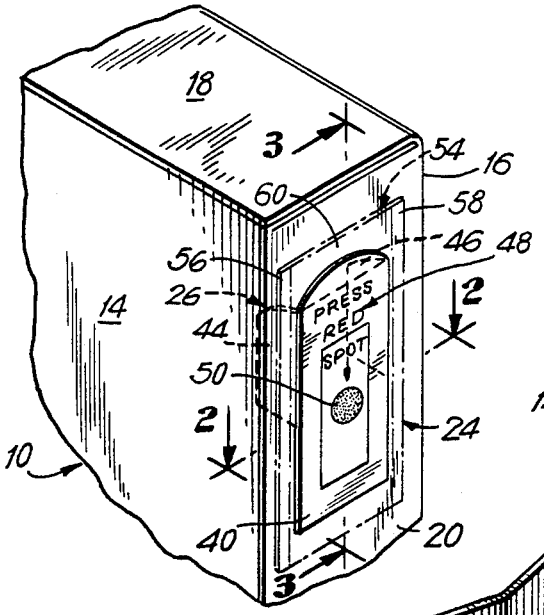
FIG. 2
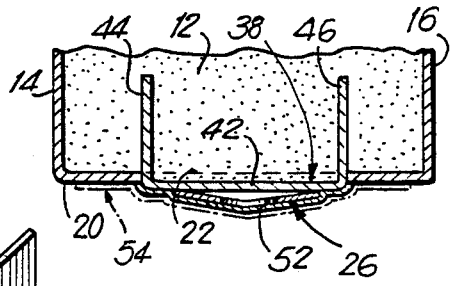
FIG. 3
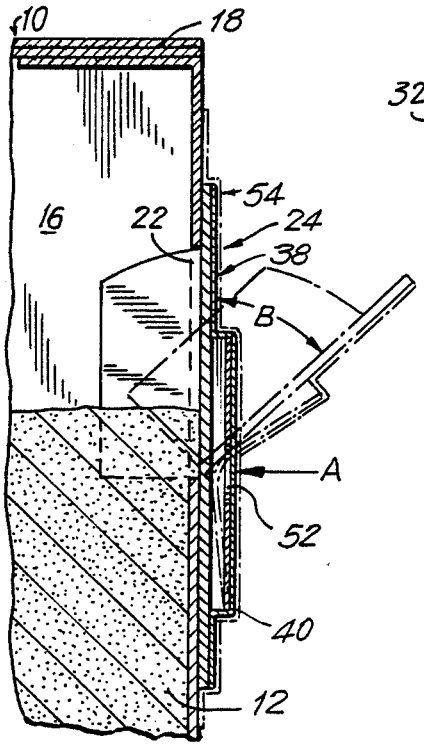
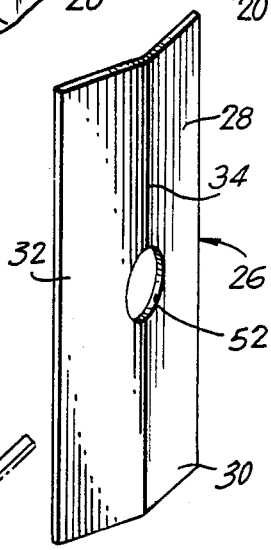
FIG. 4
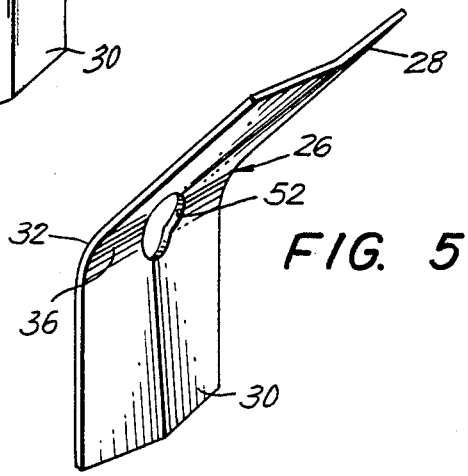
FIG. 5

DISPENSER BOX AND SNAP OPEN/SNAP SHUT CLOSURE THEREFOR

BACKGROUND OF THE INVENTION

1. Field of the Invention

The present invention generally relates to a dispenser box and a closure therefor and, more particularly, to a snap open/snap shut discharge spout assembly for use on said box.

2. Description of the Prior Art

In my prior U.S. Pat. No. 3,206,100, I disclosed a closure for a dispenser box having a hinged wall which was snapped open or closed in response to manual pressure exerted on a tensioned spring strip, one end of which was attached to a side wall of the box, and the other end of which was attached to the hinged wall. The spring strip was tensioned by a longitudinal bend to a so-called straight position. When pressure was applied on the longitudinal bend in a direction generally perpendicular thereto so as to reverse the longitudinal bend, the strip snapped into a so-called bent or bowed position in which a transverse bend was formed. The spring strip was tensioned by the transverse bend to stay in said bent position. If pressure was then applied to the strip along said perpendicular direction so as to reverse the transverse bend, then the strip snapped back into the straight position. These two positions of the spring strip were advantageously used to snap closed and snap open the hinged wall of the box.

Although generally satisfactory for its intended purpose, experience has shown that the closure described in my aforementioned patent was not altogether satisfactory in the following respects:

First of all, the angular distance through which the other movable end of the strip, i.e. the end that was attached to the hinged wall, was not large enough to pour all types of products to be dispensed. The angular distance was too small to rapidly pour certain granular products and to pour certain bulky products. Hence, my patented closure was not well suited for those applications where a large discharge opening was desired.

Secondly, the hinged wall was die-cut out of the side wall of the box. Sometimes, when the strip was moved from the closed to the open position, the hinged wall impeded such movement because the hinged wall frictionally bound with the adjacent die-cut edges of the side wall of the box. Insufficient mechanical clearance therefore existed between the hinged wall and the adjacent die-cut edges of the side wall, and this lack of clearance prevented a free and easy opening of the box.

SUMMARY OF THE INVENTION

1. Objects of the Invention

Accordingly, it is a general object of this invention to overcome the aforementioned drawbacks of dispenser boxes and closures therefor.

It is another object of this invention to increase the angular distance through which the other movable end of the aforementioned spring strip is moved.

It is a further object of this invention to more rapidly pour products from dispenser boxes than heretofore.

Still another object of this invention is to pour bulkier products from such boxes than heretofore.

Yet another object of this invention is to resist frictional binding between the die-cut edges of a discharge opening and a hinged wall of a box during opening of the same.

Another object of this invention is to provide a discrete spout assembly which is mountable as a unit on a dispenser box, and which can easily be removed from the box and mounted on another dispenser box.

A still further object of this invention is to provide a snap open-snap shut closure which is reliable in operation, inexpensive to manufacture, and easy to use.

2. Features of the Invention

In keeping with these objects, and others which will become apparent hereinafter, one feature of this invention resides, briefly stated, in a closure for a dispenser box of the type having a box wall formed with a discharge opening which lies in a plane, and preferably the same plane as the box wall itself. The closure comprises an elongated spring member or strip having opposite end portions and an apertured intermediate portion between the end portions.

The spring member is tensioned and assumes a so-called straight position by a longitudinal bend which extends lengthwise along the elongation of the spring member. One of the end portions is stationarily mounted on the box wall. The other of the end portions is movable relative to the box wall between closed and open positions in response to manual pressure exerted on the apertured intermediate portion in a direction generally normal to the longitudinal bend in order to reverse the same at the region of the apertured intermediate portion. Sufficient pressure is applied to form a transverse bend which extends widthwise across the elongation of the strip. The strip is thus tensioned by the transverse bend and assumes a so-called bent position.

In the aforementioned closed position, the other end portion of the strip overlies and closes the discharge opening. In the aforementioned open position, the other end portion extends outwardly at a predetermined angle of inclination relative to the plane of the discharge opening.

The other end portion is returnable by snap-type action from the open position to the closed position in response to manual pressure being exerted on the other end portion along said normal direction in order to reverse the transverse bend and form the longitudinal bend again at the apertured intermediate portion. The other end portion is resiliently maintained under tension by the longitudinal and transverse bend in the closed and open positions, respectively.

In accordance with one aspect of this invention, the apertured intermediate portion is provided with an opening which extends through the strip. The presence of this opening increases the angular magnitude of said angle of inclination than that which would otherwise exist if the opening were not present. Thus, in my previous patent, whereas the angular magnitude of said inclination angle was on the order of 20° relative to the vertical, the presence of the opening in the instant invention causes the angular magnitude to be about 40° to 90°. This feature provides for a large discharge opening for the box, and permits products to be dispensed from the box more rapidly than heretofore, and also permits bulkier products than heretofore to be dispensed. In addition, the closure is more affirmatively maintained in the closed position than heretofore so as to more positively prevent the entry of contaminants and vermin.

The aforementioned opening can be of any shape, i.e. the opening can be a circular hole, an oval aperture, a slit, a slot and, for that matter, any interruption extending through the intermediate portion of the strip could be employed.

Although the closure, in its broadest aspect, can include a single strip, it is also contemplated by this invention to provide a backing member and a frontal member disposed at opposite sides of, and sandwiching, the strip, thereby constituting a discrete spout assembly which is mountable as a unit on the box wall adjacent the discharge opening. Thus, a conventional dispenser box can be easily equipped with the closure of this invention and, in fact, a consumer can convert an existing box with such closure to improve its opening/closing characteristics. For that purpose, this invention also contemplates providing the spout assembly with different sizes so as to accommodate different sized discharge openings on different boxes.

In view of the discrete nature of the spout assembly, it is possible to prevent the frictional binding problem of the prior art by providing the backing member with a substantially planar base portion underlying the movable other end portion of the strip, and a pair of side wing portions, both extending generally normal to the base portion. The base and wing portions form a generally flattened, U-shaped channel through which a product to be dispensed is poured from the box. The transverse distance by which the wing portions are spaced apart is deliberately designed to be slightly less than the transverse distance by which side edges of the discharge opening are spaced apart. This permits unimpeded movement of the backing member together with the strip between the closed and open positions.

Another feature of this invention is embodied in an overlay sheet which is removably mounted over the box wall and the spout assembly in the closed position. The overlay sheet resists movement of the strip to the open position until the overlay sheet is removed, and serves as a safety feature, particularly during transport and display of the dispenser box.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 1 is a partially broken-away perspective view of an improved dispenser box equipped with a closure in a closed position in accordance with this invention;

FIG. 2 is a sectional view taken on line 2—2 of FIG. 1;

FIG. 3 is a sectional view taken on line 3—3 of FIG. 1, the phantom lines illustrating the closure in an open position;

FIG. 4 is an enlarged perspective view of an apertured spring member shown in isolation and in its so-called straight position as utilized in the closed position of FIG. 1; and FIG. 5 is a view analogous to FIG. 4, but showing the spring member in its so-called bent position as utilized in the open position indicated by phantom lines in FIG. 3.

DETAILED DESCRIPTION OF THE PREFERRED EMBODIMENTS

Referring now to the drawings, reference numeral 10 generally identifies an improved dispenser box in which a product 12 to be dispensed is stored. The product 12 may be any wet or dry, pourable substance, e.g. sugar, coffee, milk, rice, flour, salt, detergent, bleach, etc. The box 10 has a generally parallelepiped shape, and is formed with planar front 14, rear 16, top 18 and side 20 walls. A discharge opening 22 lies in the same plane as that of side wall 20 in which the discharge opening 22 is formed. The discharge opening 22 advantageously has a rectangular outline, and is cut out of the side wall 20.

A closure 24 for the box 10 is operative to open or to close the discharge opening 22. The closure 24 includes, as best shown in FIGS. 4 and 5, an elongated spring member or strip 26 having opposite end portions 28, 30, and an apertured intermediate portion 32 between the end portions. The strip 26 is tensioned to a so-called straight position, as shown in FIG. 4, by a longitudinal bend 34 which extends lengthwise along the elongation of the strip. The strip 26 is initially formed of a planar blank which is folded along the longitudinal bend. The bend 34 can be linear, as shown, so as to impart a shallow, V-shaped cross-section for the strip. Alternatively, the longitudinal bend can be slightly curved so as to impart an arcuate or bowed cross-section to the strip. Other cross-sections for the strip are also within the spirit of this invention.

When the apertured intermediate portion 32 is manually pressed in a direction generally perpendicular to the longitudinal bend 34, the bend 34 is caused to be reversed until eventually the strip 26 snaps into the so-called bent position of FIG. 5. In the bent position, the strip 26 is tensioned by a transverse fold 36 which extends widthwise across the elongation of the strip, and is formed in the region of the apertured intermediate portion 32. The strip may be returned to the straight position of FIG. 4 by exerting a manual pressure on the end portion 28 along the aforementioned perpendicular direction until the transverse fold 36 is reversed, at which time, the strip will snap back into th straight position.

The movement of the strip between its straight and bent positions is utilized to close and open the box 10. The strip 26 is advantageously sandwiched between a backing member 38 and a frontal member 40. The backing member 38 has an upper planar base 42 underlying the end portion 28 of the strip, and a pair of side wings 44, 46 spaced transversely apart from each other and extending generally perpendicular to the base 42. The base and wings form a generally flattened U-shaped channel through which the product 12 may be poured.

The frontal member 40 advantageously has indicia thereon for advising a user how to open the closure 24. The indicia include an instructional message 48, e.g. the words "press red spot", including a spot 50 overlying the apertured intermediate portion 32. The instructional message 48 may also include an arrow pointing to the spot 50.

The backing member, the strip and the frontal member together form a discrete spout assembly which is mounted as a unit on the box wall 20 adjacent the discharge opening 22. Put another way, no part of the spout assembly is of a one-piece, integral construction with the box 10. The transverse distance between the side wings 44, 46 is deliberately designed to be slightly smaller, e.g. on the order of one mil, as compared to the corresponding transverse distance between the vertical side edges of the discharge opening 22. Hence, there is no binding or mechanical interference during movement of the spout assembly between the open and closed positions.

With the strip 26 in its straight position, the spout assembly is mounted on the box wall 20 so that the lower end portion 30 of the strip, as well as lower end portions of the backing and frontal members, are stationarily mounted, e.g. by an adhesive, to the portion of the side wall 20 immediately below the discharge opening 22. The upper end portion 28 of the strip, as well as upper end portions of the backing and frontal members, overlay and close the discharge opening 22 in the closed position shown in FIG. 1, and in solid lines in FIG. 3.

As noted previously, when pressure is exerted on the apertured intermediate portion 32 in the direction of arrow A in FIG. 3, the strip snaps to the open position, shown in phantom lines in FIG. 3, and the upper end portions of the frontal and backing members participate in this movement. In the open position, the end portion 28 of the strip extends outwardly at a predetermined angle of inclination B relative to the plane of the discharge opening 22 and to the plane of the side wall 20. To return the strip to the closed position, one urges the end portion 28 in a direction generally parallel to arrow A until the strip snaps back to the straight position. Due to the tension supplied by the longitudinal and transverse bends, the strip is resiliently maintained under tension in the closed and open positions until counteracted by sufficient manual pressure exerted by a user to reverse said respective bends.

In my previous patent, the inclination angle B was small, and was approximately 20° relative to the vertical, as represented by the vertical side wall 20. Now, I have found that by forming an aperture such as circular hole 52 through the intermediate portion 32, the inclination angle B is approximately doubled in magnitude and is on the order of 40° to 90°. This creates a larger discharge channel through which the product can be more rapidly poured, and also permits bulkier products than heretofore to be dispensed. This also renders the tension exerted by the strip in the closed position to be more affirmative, so that the closure 24 is more affirmatively resiliently maintained in the closed position to help prevent entry of contaminants and vermin. The aperture need not be circular as the hole 52, but, instead, can be of any shape or outline, e.g. an oval, a slit, a slot, polygonal, etc. Any interruption through the intermediate portion 32 will provide the increased inclination angle proposed by this invention.

In order to resist the spring strip from being inadvertently moved to the open position, an overlay sheet 54 is removably mounted over the box wall 20 and the spout assembly 24 in the closed position. The overlay sheet restricts movement of the spout assembly to the open position, and retains the assembly in approximately the same plane as the side wall 20. The overlay sheet is advantageously used during transport and display of the box. To initiate dispensing, the overlay sheet 54 is peelably removed from over the assembly 24.

Due to the discrete nature of the spout assembly 24, it can be individually sold in various sizes to convert existing boxes of different sizes to ones which are equipped with the novel closure proposed herein.

The spring strip itself may be made of any springy material, and includes such materials as metals and plastics. The closure need not be of the multi-part construction shown in the drawings, but may also be constituted of a single spring member.

The discharge opening 22 may also be located in other planes than the vertical plane of the side wall. For example, it may be located on the top wall of the box, which is particularly advantageous for pouring liquids, such as milk.

The term "box" as employed herein is intended to broadly cover all types of containers, such as cartons or cans.

In order to resist tampering with the product, the overlay sheet 54 is made in sections. Side sections 56, 58 on opposite sides of the closure are permanently attached to the side wall, preferably with a permanent adhesive. Main section 60 overlying the closure is peelably attached to the side wall, and can be removed easily prior to use. The visual presence of the side sections prior to removal by the authorized user indicates that prior tampering may have occurred.

It will be understood that each of the elements described above, or two or more together, also may find a useful application in other types of constructions differing from the types described above.

While the invention has been illustrated and described as embodied in an improved dispenser box and snap open/snap shut closure therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A closure for a dispenser box having a box wall formed with a discharge opening lying in a plane, said closure comprising:

(a) an elongated spring member having opposite end portions and an intermediate portion between the end portions, (b) said spring member being tensioned by a longitudinal bend extending lengthwise along the elongation of the spring member, (c) one of the end portions being stationarily mounted on the box wall, (d) the other of the end portions being movable relative to the box wall, in response to manual pressure exerted on the intermediate portion in a direction generally normal to the longitudinal bend to reverse the longitudinal bend at the intermediate portion to form a transverse bend extending widthwise across the elongation of the spring member, from (i) a closed position in which the other end portion overlies and closes the discharge opening, to (ii) an open position in which the other end portion extends outwardly at a predetermined angle of inclination relative to the plane of the discharge opening, (e) said intermediate portion having an opening which extends through the spring member and which increases the angular magnitude of said angle of inclination than that which would exist if the opening were not present, (f) said other end portion being returnable from the open position to the closed position in response to manual pressure exerted on the other end portion in said normal direction to reverse the transverse bend and form the longitudinal bend again at the intermediate portion, and (g) said other end portion being resiliently maintained under tension by the longitudinal and transverse bends in the closed and open positions respectively.

2. The closure as recited in claim 1, wherein the opening is a circular hole.

3. The closure as recited in claim 1; and further comprising a backing member and a frontal member disposed at opposite sides of, and sandwiching, the spring member; and wherein the backing, spring and frontal members constitute a discrete spout assembly which is mountable as a unit on the box wall adjacent the discharge opening.

4. The closure as recited in claim 3, wherein indicia indicative of instructions for opening the spout assembly are applied on the frontal member, said indicia including a spot over the opening.

5. The closure as recited in claim 3, wherein the backing member has a substantially planar base underlying the movable other end portion of the spring member, and a pair of side wings extending generally normal to the planar base and forming a generally flattened, U-shaped channel through which a product to be dispensed is poured from the box.

6. The closure as recited in claim 5, wherein the discharge opening has side edges spaced transversely apart by a predetermined distance, and wherein the side wings are spaced transversely apart by a distance less than said predetermined distance to permit unimpeded movement of the backing member together with the spring member between the closed and open positions.

7. The closure as recited in claim 3; and further comprising an overlay sheet removably mounted over the box wall and the spout assembly in the closed position of the spring member, to resist the spring member from being moved to the open position until the overlay sheet is removed.

8. The closure as recited in claim 7, wherein the overlay sheet includes a first section permanently attached to the side wall, and a main section overlying the closure and peelably attached to the side wall.

9. A dispenser box comprising:

(A) a container having a box wall formed with a discharge opening lying in a plane; and (B) a closure including (a) an elongated spring member having opposite end portions and an intermediate portion between the end portions, (b) said spring member being tensioned by a longitudinal bend extending lengthwise along the elongation of the spring member, (c) one of the end portions being stationarily mounted on the box wall, (d) the other of the end portions being movable relative to the box wall, in response to manual pressure exerted on the intermediate portion in a direction generally normal to the longitudinal bend to reverse the longitudinal bend at the intermediate portion to form a transverse bend extending widthwise across the elongation of the spring member, from (i) a closed position in which the other end portion overlies and closes the discharge opening, to (ii) an open position in which the other end portion extends outwardly at a predetermined angle of inclination relative to the plane of the discharge opening, (e) said intermediate portion having an opening which extends through the spring member and which increases the angular magnitude of said angle of inclination than that which would exist if the opening were not present, (f) said other end portion being returnable from the open position to the closed position in response to manual pressure exerted on the other end portion in said normal direction to reverse the transverse bend and form the longitudinal bend again at the apertured intermediate portion, and (g) said other end portion being resiliently maintained under tension by the longitudinal and transverse bends in the closed and open positions respectively.

* * * * *